US006348645B1

(12) United States Patent
Yamashita

(10) Patent No.: US 6,348,645 B1
(45) Date of Patent: Feb. 19, 2002

(54) DAMPER FOR GRAND PIANO

(75) Inventor: Mitsuo Yamashita, Shizuoka-ken (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/838,315

(22) Filed: Apr. 20, 2001

(30) Foreign Application Priority Data

May 12, 2000 (JP) ..... 2000-139475

(51) Int. Cl.[7] ..... G10C 3/00
(52) U.S. Cl. ..... 84/217
(58) Field of Search ..... 84/216, 217, 218, 84/219, 240, 241, 243

(56) References Cited

U.S. PATENT DOCUMENTS 4,879,939 A * 11/1989 Wall ..... 84/240
4,924,742 A * 5/1990 Numata et al. ..... 84/218
5,545,839 A * 8/1996 Kawamura et al. ..... 84/171
6,020,544 A * 2/2000 Jones et al. ..... 84/218

* cited by examiner

*Primary Examiner*—Robert E. Nappi
*Assistant Examiner*—Kim Lockett
(74) *Attorney, Agent, or Firm*—Crowell & Moring LLP

(57) ABSTRACT

There is disclosed a damper for a grand piano, which is simple in construction and can be manufactured at reduced costs by reducing the number of components, the number of assembling steps, and the number of adjustment operations. A damper for a grand piano moves out of contact with strings in a manner interlocked with operation of a damper pedal, to thereby create a damper pedal effect. A plurality of damper levers each have a rear end portion thereof pivotally mounted to the damper rail and each extend forward. Each damper head is connected to the upper side of a corresponding one of the plurality of damper levers and brought out of contact with a corresponding one of the strings as the corresponding damper lever moves upward. A lifting rail is arranged below the plurality of damper levers, for pivotally moving the plurality of damper levers upward simultaneously by being pushed upward when the damper pedal is operated. The damper lever rail and the lifting rail are formed by a molded component as a unitary member and arranged in a pivotally movable manner.

2 Claims, 2 Drawing Sheets

DAMPER FOR GRAND PIANO

BACKGROUND OF THE INVENTION

1. Field of the Invention

This invention relates to a damper for a grand piano, which moves into and out of contact with strings in a manner interlocked with operation of a pedal or the like, to thereby stop and allow vibration of the strings, and more particularly to a structure of a rail for supporting damper levers.

2. Description of the Prior Art

FIG. 2 shows part of a conventional damper of a general type for a grand piano. The damper 51 is comprised of a damper lever rail 52, a plurality of damper levers 3, and a plurality of damper heads (see FIG. 1) associated with the respective damper levers 3. The damper lever rail 52 formed by an extruded component of aluminum is arranged behind a plurality of keys, not shown, in a manner extending along a direction of a row of the keys. The plurality of damper levers 3 are each provided for a corresponding one of the keys. Each damper lever 3 has a rear end portion thereof pivotally supported by the damper lever rail 52 via a damper lever flange 5 and a front end portion thereof opposed to the rear end portion of the corresponding key from above. A damper wire flange 6 is pivotally mounted to the damper lever 3, and a damper wire 7 extends upward from the damper wire flange 6. The damper head is attached to the upper end of the damper wire 7 such that the damper head can be brought into and out of contact with a string, not shown, stretched horizontally below the damper head (see FIG. 1).

In the damper 51 constructed as above, when a key is depressed, a corresponding one of the damper levers 3 is pushed upward by the rear end portion of the key, and in unison with the upward movement of the damper lever 3, a damper head corresponding to the damper lever 3 moves upward out of contact with a corresponding string. Then, a hammer, not shown, which pivotally moves in a manner interlocked with key depression strikes the string, whereby the string is caused to vibrate to generate a piano tone. On the other hand, when the key is released, the damper lever 3 pivotally moves downward to return to its original position, and in unison with the downward movement of the damper lever 3, the damper head moves downward into contact with the string, whereby the vibration of the string or sounding of the piano tone is stopped.

The damper 51 further includes a lifting rail 58. The lifting rail 58 formed by an extruded component of aluminum is arranged below the plurality of damper levers 3 in a manner extending along a direction of a row of the damper levers 3. The lifting rail 58 is connected to the damper lever rail 52 by a plurality of connection members 60. The connection members 60 each formed by a wooden block are arranged in a manner spaced from each other in the direction of the row of the damper levers 3 and each placed on the two rails 52, 58 in a manner bridging them. Each connection member 60 is fixed to the two rails 52, 58 by screws 61 from above, thereby connecting the rails 52, 58 to form a unitary assembly.

Further, the outermost two of the plurality of connection members 60 (only one of them is shown in the figure) each have a pin 62 projecting outward therefrom. The pins 62 are rotatably fitted in and supported by a piano body, not shown, such that the unitary assembly of the damper lever rail 52 and the lifting rail 58 can pivotally move in unison with the pins 62 about the rotational axis thereof. The lifting rail 58 is placed on a damper lift rail pitman 9 extending vertically.

The damper lift rail pitman 9 has a lower end portion thereof connected to a damper pedal, not shown.

In the construction described above, when the damper pedal is stepped on, the lifting rail 58 is pushed upward by the damper lift rail pitman 9 to cause the unitary assembly of the lifting rail 58 and the damper lever rail 52 to pivotally move upward in unison with the pins 62 about the rotational axis thereof. As a result, all the damper levers 3 are pivotally moved upward to bring all the damper heads out of contact with the respective strings simultaneously, which allows resonance between strings corresponding to depressed keys and ones corresponding to other keys to thereby create a damper pedal effect.

In the above conventional damper 51, however, since the plurality of connection members 60 are used to connect the damper lever rail 52 and the lifting rail 58, it is required to machine and provide the connection members 60 in advance. Further, it is required to carry out the troublesome assembling operation of placing each connection member 60 on the two rails 52, 58 in a manner bridging them and then fixing the connection member 60 to the rails 52, 58 by the screws 61. In addition, in this assembling operation, it is required to adjust the positional relationship between the two rails 52, 58 properly such that each damper lever 3 can be properly pushed upward by a corresponding key associated therewith and at the same time, all the damper levers 3 can be pivotally moved upward simultaneously by the lifting rail 58. Moreover, since the connection members 60 are formed of wood, warpage of the connection members 60 and loosening of the screws 61 can occur after the above adjustment. Therefore, even if the positional relationship between the two rails 52, 58 is properly adjusted during the assembling operation, the positional relationship can change with the lapse of time, which requires readjustment.

SUMMARY OF THE INVENTION

It is an object of the invention to provide a damper for a grand piano, which is simple in construction and can be manufactured at reduced costs by reducing the number of components, the number of assembling steps, and the number of adjustment operations.

To attain the above object, the present invention provides a damper for a grand piano, which moves out of contact with strings in a manner interlocked with operation of a damper pedal, to thereby create a damper pedal effect to a musical tone generated.

The damper according to the invention is characterized by comprising:

- a damper lever rail;
- a plurality of damper levers each having a rear end portion thereof pivotally mounted to the damper rail and each extending forward;
- damper heads each of which is connected to an upper side of a corresponding one of the plurality of damper levers and brought out of contact with a corresponding one of the strings as the corresponding damper lever pivotally moves upward; and
- a lifting rail arranged below the plurality of damper levers, for pivotally moving the plurality of damper levers upward simultaneously by being pushed upward when the damper pedal is operated,
- wherein the damper lever rail and the lifting rail are formed by a molded component as a unitary member and arranged in a pivotally movable manner.

According to this damper for a grand piano, the damper lever rail and the lifting rail are formed by a molded component as a unitary member, and the plurality of damper levers are pivotally mounted to the damper lever rail (portion) of the molded component. Further, the molded component is pivotally mounted in the grand piano such that when the damper pedal is stepped on, the lifting rail is pushed upward to pivotally move the plurality of damper levers upward simultaneously. When all the damper levers are moved upward simultaneously, the plurality of damper heads are all brought out of contact with the respective strings, whereby a damper pedal effect is created.

As described above, according to the damper of the present invention, the damper lever rail and the lifting rail are formed by the molded component as a unitary member while maintaining the function of a damper rail for pivotally supporting a plurality of damper levers and the function of a lifting rail for providing a damper pedal effect in accordance with depression of a damper pedal. Therefore, it is possible to dispense with all the connection members conventionally used for connecting the two rails, thereby reducing the number of components and simplifying the construction of the damper. Further, for the same reason, it is possible to dispense with the operations of assembling the two rails by using the connection member and adjusting the positional relationship between the rails. As a result, manufacturing costs of the damper can be reduced.

Preferably, the molded component is an extruded component of aluminum.

According to this preferred embodiment, since the molded component is an extruded component of aluminum which ensures a high dimensional accuracy and stability, it is possible to mount the damper rail and the lifting rail in the grand piano accurately in a less warpage-prone, stable state.

The above and other objects, features, and advantages of the invention will become more apparent from the following detailed description taken in conjunction with the accompanying drawings.

DETAILED DESCRIPTION OF PREFERRED EMBODIMENT

Figure 1:
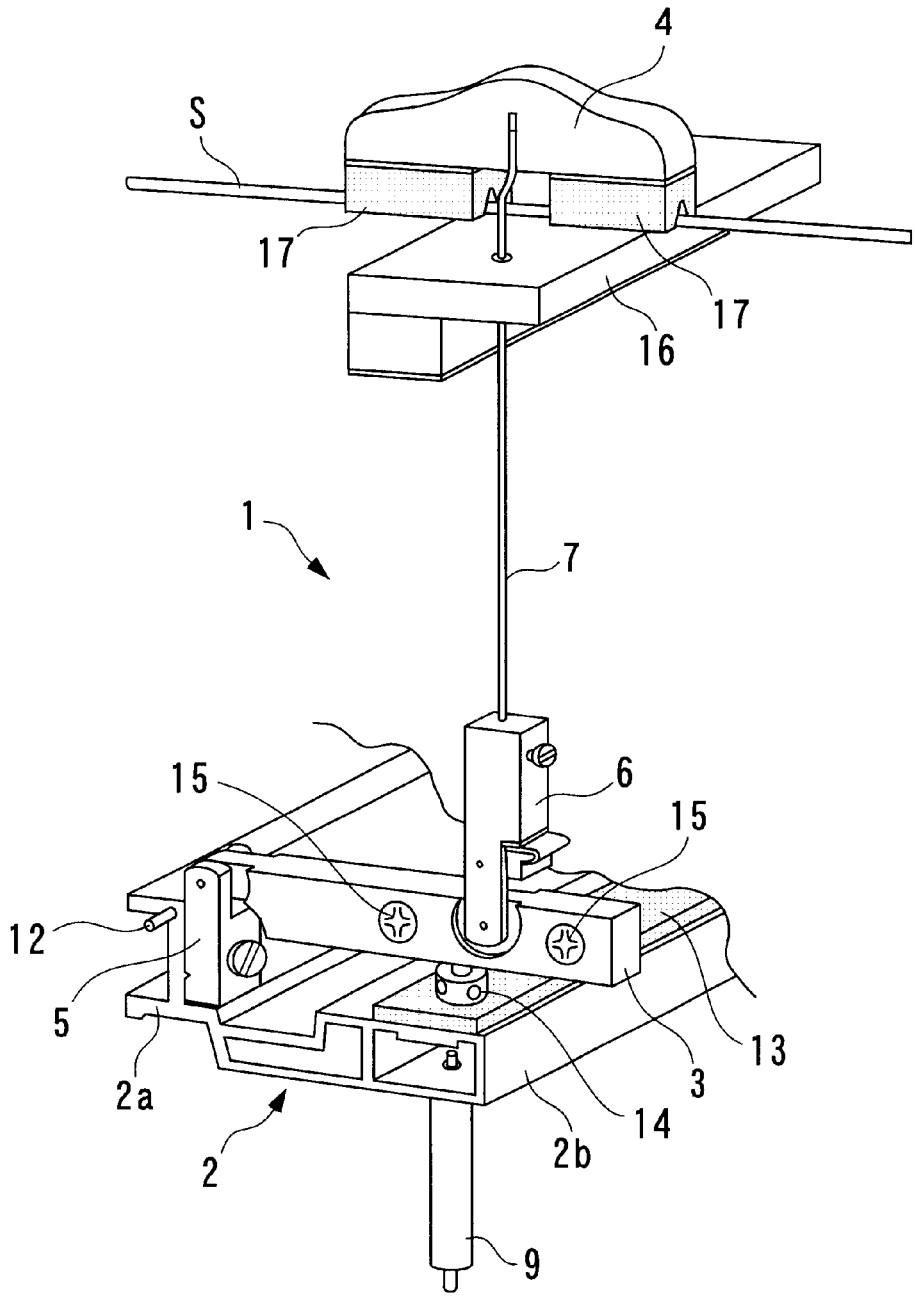
FIG. 1 is a perspective view of a damper for a grand piano, according to an embodiment of the present invention.
Figure 2:
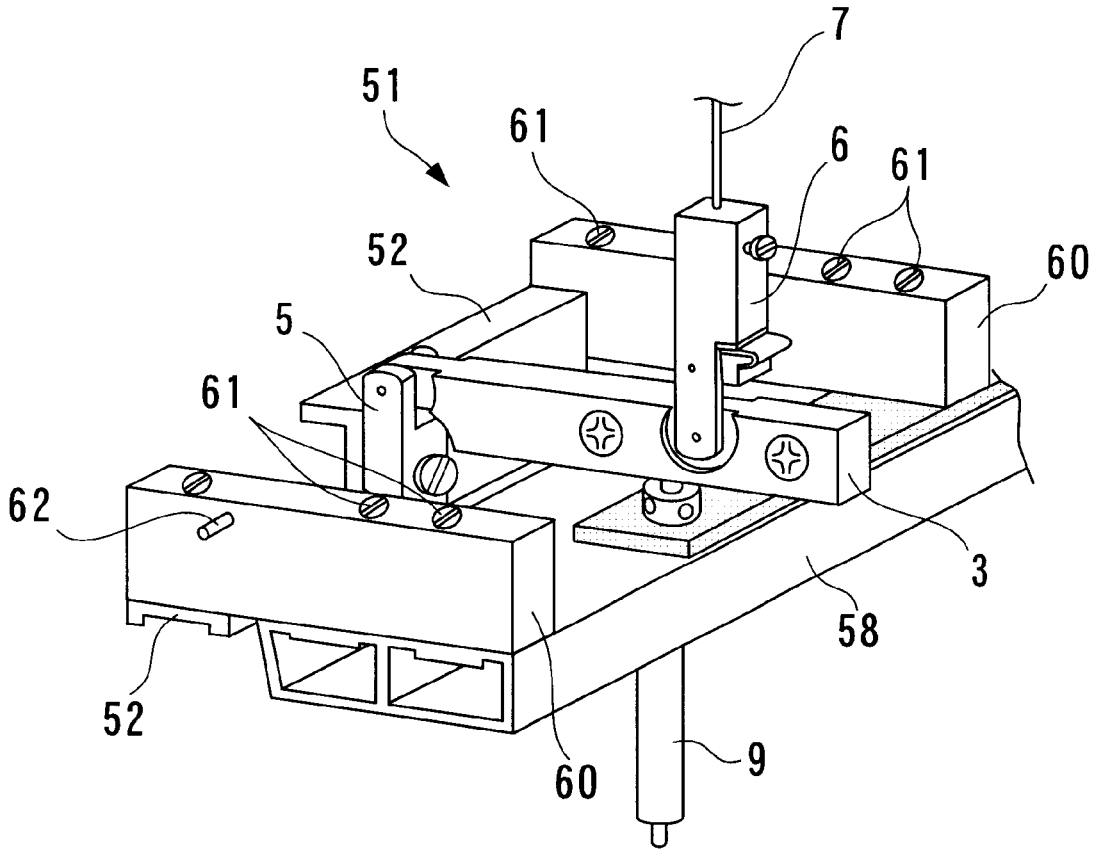
FIG. 2 PRIOR ART
FIG. 2 is a perspective view of a conventional damper for a grand piano.

The invention will now be described in detail with reference to FIG. 1 showing a damper for a grand piano, according to an embodiment thereof. In the following description, component parts and elements of the damper 1 similar to those of the conventional damper 51 shown in FIG. 2 are designated by identical reference numerals.

The damper 1 is comprised of a damper rail 2, a plurality of damper levers 3, and a plurality of damper heads 4 associated with the respective damper levers 3. The damper rail 2 according to the present invention is an unitary member having integrated therein a damper lever rail portion 2*a* corresponding to the conventional damper lever rail 52 and a lifting rail portion 2*b* corresponding to the conventional lifting rail 58. The damper rail 2 is formed by an extruded component of aluminum and arranged behind a plurality of keys, not shown, in a manner extending along a direction of a row of the keys.

The damper lever rail portion 2*a* pivotally supports the rear end portions of the respective damper levers 3 (only one of them is shown in the figure) each associated with a corresponding one of the keys, via respective damper flanges 5. Each damper lever 3 extends forward such that the front end portion thereof is opposed to the rear end portion of the corresponding key from above. Further, the damper lever rail portion 2*a* has pins 12 (only one of them is shown in the figure) projecting horizontally from respective predetermined positions on opposite side faces thereof, and the damper rail 2 is pivotally mounted to a piano body, not shown, via the pins 12.

The lifting rail portion 2*b* is placed on a damper lift rail pitman 9 extending vertically. The damper lift rail pitman 9 has a lower end portion thereof connected to a damper pedal, not shown. Affixed to the top surface of the lifting rail portion 2*b* is a lifting rail cloth 13 in a manner extending longitudinally along the lifting rail portion 2*b*, and an adjusting pilot screw 14 screwed into the bottom of each damper lever 3 is opposed to the lifting rail cloth 13 from above with a predetermined space or distance provided therebetween.

A weight 15 formed e.g. of lead is attached to each damper lever 3, so as to add weight to the damper lever 3. Further, the damper lever 3 has a lower end portion of a corresponding damper wire flange 6 connected thereto, and a damper wire 7 extends upward from the damper wire flange 6. The damper wire 7 is inserted through a guide holder 16 for guiding the damper wire 7 so as to prevent the same from swinging in a horizontal direction. The damper head 4 is attached to the upper end of the damper wire 7. The damper head 4 which is formed of wood is brought into and out of contact with a string S stretched horizontally below the damper head 4, via a damper felt 17 attached to the bottom of the damper head 4.

The operation of the damper 1 constructed as above is basically similar to that of the conventional damper 51 described hereinabove. That is, when a key is depressed, the damper lever 3 is pushed upward by the rear end portion of the key to be pivotally moved upward. As the damper lever 3 is pivotally moved upward, the damper head 4 moves upward out of contact with the string S. Then, a hammer, not shown, strikes the string S at a predetermined timing to cause vibration of the string S, whereby a piano tone is generated. On the other hand, when the key is released, the damper lever 3 pivotally moves downward to return to its original position. As the damper lever 3 moves downward, the damper head 4 moves downward into contact with the string S. As a result, the vibration of the string S is stopped by the weight of the damper lever 3 and the damper head 4, whereby the sounding is stopped.

Further, when the damper pedal is stepped on, the lifting rail portion 2*b* of the damper rail 2 is pushed upward by the damper lift rail pitman 9, whereby the damper rail 2 is pivotally moved upward with the pins 12 about the rotational axis thereof. This causes all the damper levers 3 to be pushed upward via the respective pilot screws 14 to bring all the damper heads 4 out of contact with the respective strings S simultaneously, where by a damper pedal effect is created. Then, when the damper pedal is released, the damper rail 2 is pivotally moved downward by its own weight to return to its original position. As the damper rail 2 moves downward, each damper lever 3 pivotally moves downward to bring the corresponding damper head 4 into contact with the corresponding string S, i.e. to return the damper head 4 to its original position.

As described above, according to the damper 1 of the present embodiment, the damper rail 2 is configured to be an unitary member having integrated therein the damper lever rail portion 2*a* and the lifting rail portion 2*b* while maintaining the function of a damper rail for pivotally supporting a plurality of damper levers 3 and the function of a lifting rail for creating a damper pedal effect in accordance with depression of a damper pedal. Therefore, it is possible to dispense with all the connection members conventionally used for connecting the two rails, thereby reducing the number of components and simplifying the construction of the damper 1. Further, for the same reason, it is no longer necessary to carry out the operations of assembling the two rails and adjusting the positional relationship between the rails. As a result, manufacturing costs of the damper can be reduced.

Moreover, since the damper rail 2 is formed by an extruded component of aluminum which ensures high dimensional accuracy and stability, it is possible to mount the damper rail 2 in a grand piano accurately in a less warpage-prone, stable state.

It should be noted that the invention is not limited to the embodiment described above, but it can be practiced in various ways. For instance, although in the above embodiment, the damper rail 2 is formed by an extruded component of aluminum, it may be formed by another kind of molded component, such as a press molded component of steel. Further, although in the embodiment, the invention is applied to a grand piano, it may be applied to a silent piano of a grand type or the like. In addition, it is possible to change configurations of details of the damper, such as the shape of the damper rail, as required, within the scope of the invention.

It is further understood by those skilled in the art that the foregoing is a preferred embodiment of the invention, and that various changes and modifications can be made without departing from the spirit and scope thereof.

What is claimed is:

1. A damper for a grand piano, which moves out of contact with strings in a manner interlocked with operation of a damper pedal, to thereby create a damper pedal effect, the damper comprising:

a damper lever rail;

a plurality of damper levers each having a rear end portion thereof pivotally mounted to said damper rail and each extending forward;

damper heads each of which is connected to an upper side of a corresponding one of said plurality of damper levers and brought out of contact with a corresponding one of said strings as said corresponding damper lever pivotally means upward; and a lifting rail arranged below said plurality of damper levers, for pivotally moving said plurality of damper levers upward simultaneously by being pushed upward when said damper pedal is operated, wherein said damper lever rail and said lifting rail are formed by a molded component as a unitary member and arranged in a pivotally movable manner.

2. A damper for a grand piano, according to claim 1, wherein said molded component is an extruded component of aluminum.

* * * * *